US006589148B2

(12) United States Patent
Tarka

(10) Patent No.: US 6,589,148 B2
(45) Date of Patent: Jul. 8, 2003

(54) MOVEABLE PRESSER RAIL ASSEMBLY

(76) Inventor: Michael P. Tarka, 4 Pell St., Apartment 2, Ludlow, MA (US) 01238

( * ) Notice: Subject to any disclaimer, the term of this patent is extended or adjusted under 35 U.S.C. 154(b) by 66 days.

(21) Appl. No.: 09/924,809

(22) Filed: Aug. 8, 2001

(65) Prior Publication Data

US 2003/0032539 A1 Feb. 13, 2003

(51) Int. Cl.[7] ..... B65H 35/00

(52) U.S. Cl. ..... 493/373; 493/468; 493/82; 493/83; 493/73; 493/56; 493/473; 493/478

(58) Field of Search ..... 493/373, 468, 493/82, 83, 73, 56, 473, 478; 225/97, 103, 104; 83/640, 543; 269/266

(56) References Cited

U.S. PATENT DOCUMENTS

| | | | | | |
|---|---|---|---|---|---|
| 3,610,138 | A | | 10/1971 | Galter | |
| 4,171,081 | A | * | 10/1979 | Vossen et al. | 225/97 |
| 4,202,263 | A | | 5/1980 | Schulte | |
| 4,248,370 | A | * | 2/1981 | Schroter | 225/91 |
| 5,094,159 | A | | 3/1992 | Manschwetus | |
| 5,134,929 | A | | 8/1992 | Jonkka et al. | |
| 5,322,202 | A | * | 6/1994 | Pelletier | 225/97 |
| 5,340,082 | A | | 8/1994 | Holloway | |
| 5,372,062 | A | | 12/1994 | Jonkka et al. | |
| 5,386,751 | A | * | 2/1995 | Dylla et al. | 83/18 |
| 5,529,565 | A | | 6/1996 | Oetlinger | |
| 5,599,269 | A | | 2/1997 | Oetlinger | |
| 5,605,527 | A | * | 2/1997 | Gillieron | 493/342 |
| 5,766,123 | A | | 6/1998 | Oetlinger | |
| 5,810,233 | A | | 9/1998 | Varidel | |
| 5,964,686 | A | * | 10/1999 | Bidlack et al. | 493/59 |
| 6,070,522 | A | | 6/2000 | Koljonen | |

* cited by examiner

*Primary Examiner*—Stephen F. Gerrity
*Assistant Examiner*—Brian D Nash
(74) *Attorney, Agent, or Firm*—Malcolm J. Chisholm, Jr.

(57) ABSTRACT

The invention is a moveable presser rail assembly for supporting blanking material during operation of a blanking tool for making packaging blanks. The moveable presser rail assembly includes a mount housing having a cavity that pivotally secures a pivot sleeve, and a guide strut is secured within the pivot sleeve by a spring biasing mechanism so that a fastening end of the guide strut may be rigidly secured to a presser rail. Because the guide strut may pivot within the mount housing, the presser rail may be rigidly secured to the guide strut and still provide reciprocating and non-parallel or limited lateral motion relative to a support plate that supports the mount housing.

9 Claims, 8 Drawing Sheets

MOVEABLE PRESSER RAIL ASSEMBLY

TECHNICAL FIELD

The present invention relates to a blanking tool for making packaging blanks, and in particular relates to a moveable presser rail assembly for supporting blanking material during operation of the blanking tool.

BACKGROUND OF THE INVENTION

It is well known in the manufacture of packaging containers, such as thin cardboard boxes for facial tissue, breakfast cereal, etc., that large packaging material sheets are cut to have a plurality of smaller sheets having identical outlines. The smaller sheets of material are referred to as blanks. One method of removing the blanks from the large sheets is to manually separate the blanks from the sheets, which is very labor intensive, and hence quite costly. An alternative method of removing the blanks from the large sheets is to use a male blanker on a top side of the large sheet that is cooperatively aligned with a female blanker on a bottom side of the sheet that supports the sheet.

As shown in FIG. 1, a male blanker 10 includes a plurality of presser members 12A, 12B, 12C, 12D, 12E secured to a support plate 13, and the presser members 12A–12E are dimensioned to be the same shape and slightly smaller than the blanks 14A, 14B, 14C, 14D, 14E of a large sheet 16 supported upon a female blanker 18. Next to and between the presser members 12A–12E are a plurality of prior art presser rails 20. (Only one of the identical six illustrated presser rails in FIG. 1 is identified by the reference number 20 to avoid confusion.) Each prior art presser rail includes two mount housings 22A, 22B that secure the presser rail 20 to the support plate 13. Each mount housing 22A, 22B includes a guide strut 24A, 24B that is secured within the mount housing by a spring biasing mechanism such as a captured coil spring (not shown), and the guide struts 24A, 24B are secured to the presser rail 20. The spring biasing mechanism forces the presser rail 20 in a direction away from the support plate 13 and mount housings 22A, 22B.

As is well known, in operation the support plate 13 is moved against the sheet 16 as shown in FIG. 2 so that the presser rail 20 secures the large sheet 16 as the presser members 12A–12E impact the blanks 14A–14E to force them to break apart from the large sheet 16 and move with gravity assistance and a stacking machine (not shown) to blank staking piles 26A, 26B, 26C, 26D, 26E. After the blanks 14A–14E are removed from the large sheet 16, the sheet is referred to as blanking scrap. As is apparent, the faster the large sheet 16 can be processed by the male and female blankers 10, 18, the more cost efficient is the blanking operation. A substantial limitation on efficient processing of the sheet 16 and blanks 14A–14E is associated with jamming of blanking scrap that is inadequately secured by the presser rails 20. The presser rails 10 must be able to apply a relatively uniform force to the large sheet 16, even when the sheet is not completely flat. Therefore it has become important that presser rail assemblies permit the presser rail 20 to evenly apply a force even when the rail 20 is not aligned to be parallel with a plane defined by the support plate 13, such as when a piece of blanking scrap is jammed between the presser rail and a subsequent large sheet.

Known presser assemblies have endeavored to solve this problem by permitting limited pivoting of a presser rail relative to a guide strut securing the presser rail to a support frame. For example, in U.S. Pat. No. 5,529,565 that issued on Jun. 25, 1996 to Oetlinger, which Patent is hereby incorporated herein by reference, a presser assembly is disclosed that has a presser rail having a first end pivotally mounted to a first guide strut, and a second end mounted either rigidly or pivotally to a second guide strut so that each end of the presser rail may move toward or away from a support plate independently of the other end of the presser rail. While the Oetlinger presser assembly does permit a uniform application of force to the presser rail by the guide struts while the presser rail is not parallel to the support plate, because at least one presser rail end is pivotally secured to the guide strut, the Oetlinger presser assembly is quite difficult to mechanically secure to the support plate, and requires a complicated and strong pivot joint between the guide strut and the presser rail. Therefore the Oetlinger presser assembly requires strong metal components that are costly to manufacture and assemble onto the support plate. Additionally, the Oetlinger presser assembly is typically manufactured with both rigid and pivoting guide rod components, so a user must stock, service and replace two different types of presser assemblies.

As is apparent from prior art FIGS. 1 and 2, as a different sized blank is to be made from a sheet 16, the presser rail 20 and mount housings 22A, 22B must be separated from each other and secured to differing positions on the support plate 13. Because the Oetlinger presser assembly includes a pivot mechanism between the guide rod and the presser rail, it is time consuming to disconnect the many pivoting guide rods and to re-connect them in new positions. Additionally, the presser rails must be manufactured to receive a pivot mechanism to enable pivoting between the presser rail and guide rod, rather than the presser rail having just a throughbore to be rigidly secured in a non-pivoting manner to the to the guide rod or strut.

Accordingly, there is a need for a simplified, pivoting or moveable presser rail assembly that affords inexpensive manufacture and installation of a presser rail to a support plate of a blanking tool.

SUMMARY OF THE INVENTION

The invention is a moveable presser rail assembly for supporting blanking material during operation of a blanking tool for making packaging blanks. The moveable presser rail assembly includes a mount housing having a cavity that defines at least one stop shoulder, a first conical shoulder and an opposed second conical shoulder that both protrude into the cavity. First and second tips of the first and second conical shoulders are at points of farthest protrusion of the shoulders into the cavity. A pivot sleeve is dimensioned to be secured within the cavity of the mount housing so that whenever an upper edge of the pivot sleeve contacts the stop shoulder, contact corners of first and second convex edges of the pivot sleeve are positioned adjacent to the tips of the first and second conical shoulders within the cavity of the mount housing. The first and second contact corners of the first and second convex edges of the pivot sleeve are defined as being a farthest distance from each other on the pivot sleeve. A guide strut is secured within the pivot sleeve by a spring biasing mechanism that biases a fastening end of the guide strut in a direction away from the mount housing. And, a presser rail is rigidly secured to the fastening end of the guide strut.

In use of the moveable presser rail assembly, the mount housing is secured over a throughbore of a support plate so that the fastening end of the guide strut passes through the throughbore to be rigidly secured to the presser rail, and the throughbore is dimensioned to have a substantially greater length than a diameter of the guide strut so that the guide strut may move in a direction that is not only perpendicular to a plane defined by the support plate. As the presser rail is moved directly toward the mount housing, the guide strut moves through the pivot sleeve within the cavity of the mount housing. Whenever the presser rail receives a force that is not perpendicular to the support plate but instead is toward and lateral to the support plate, the guide strut may move toward the support plate and laterally in such a non-perpendicular direction causing the contact corners of the convex edges of the pivot sleeve to slide out of contact with the tips of the conical shoulders. For example, if the presser rail were to move in a direction forcing the guide strut both toward the support plate and the second conical shoulder, the contact corner of the second convex edge of the pivot sleeve would slide up and over the second conical shoulder in a direction away from the support plate, while the opposed contact corner of the first convex edge of the pivot sleeve would slide down and away from the first conical shoulder in a direction toward the support plate. Whenever the lateral force is no longer applied to the guide strut through the presser rail, the spring biasing of the guide strut will return the contact corners of the convex edges of the pivot sleeve to be adjacent the tips of the conical shoulders so that the guide strut is returned to a normal or perpendicular position relative to the support plate and the presser rail is again parallel to a plane defined by the support plate.

By providing spring-biased, pivoting or lateral movement along with reciprocating movement of the guide strut relative to the support plate through the cooperative relationship of the pivot sleeve, stop shoulder and conical shoulders, the moveable presser assembly permits rigid attachment of the presser rail to the fastening end of the guide strut, rather than a complicated pivot assembly between the guide strut and presser rail. That rigid attachment greatly simplifies manufacture, assembly and replacement of the moveable presser rail assembly within a complicated work environment of a blanking tool.

In a preferred embodiment, the spring biasing means includes a forked spring receiver that is secured to the pivot sleeve and extends from the pivot sleeve in a direction opposed to the fastening end of the guide strut, and a spring end of the guide strut opposed to the fastening end includes a spring bore defined between opposed fingers of the guide strut. The spring receiver secures a first end of a coil spring and the opposed second end is secured within the spring bore of the guide strut. The guide strut may also include at least one mount shoulder that passes through a guide slot of the pivot sleeve toward the forked spring receiver in compressing the coil spring between the spring receiver and the guide strut, and when compressed, at least one lock rod may pass through the pivot sleeve dimensioned to restrict travel of the mount shoulder back through the pivot sleeve to thereby secure the spring biased guide strut within the pivot sleeve.

In such an embodiment, the pivot sleeve and spring biased guide strut are thereby prepared for insertion into the cavity of the mount housing through a cavity entrance. The mount housing may then be placed so that the cavity entrance overlies the throughbore of the support plate to which the moveable presser rail assembly is to be secured. The throughbore of the support plate is dimensioned to permit limited lateral movement of the guide strut, but is also dimensioned to have a width that is less than a longest distance between the contact edges of the pivot sleeve to restrict movement of the pivot sleeve out of the cavity of the mount housing. The presser rail may then be secured to the fastening end of the guide strut in preparing the blanking tool for operation.

By enabling lateral movement of the guide strut through the cooperative relationship of the pivot sleeve, stop shoulder, and conical shoulders, and thus enabling a rigid attachment of the guide strut to the presser rail, the moveable presser assembly provides for a strong assembly that may be fabricated of plastic materials that can he manufactured at modest cost compared to known high-strength, small-diameter metal components that provide for a presser rail to be pivotally mounted to a reciprocating guide cylinder. Additionally, because of the efficient and rugged design characteristics of the moveable presser rail assembly, a plurality of identical moveable presser rail assemblies may simply be secured to one presser rail, rather than known presser rail assemblies that require a first presser having a pivotable guide strut and a second presser having a rigid or slotted guide strut secured to a single presser rail to enable limited lateral, or non-perpendicular movement.

Accordingly, it is a general object of the present invention to provide a moveable presser rail assembly that overcomes deficiencies of prior art presser rail assemblies.

It is a more specific object to provide a moveable presser rail assembly that enables a presser rail to be rigidly secured in a non-pivoting manner to a guide strut of the assembly.

It is yet another object to provide a moveable presser rail assembly that provides for movement of a presser rail that moves in non-parallel alignment with a support plate supporting the assembly.

It is a further object to provide a moveable presser assembly that may be manufactured of plastic materials.

It is an additional object to provide a moveable presser rail assembly that facilitates assembly and replacement of a presser rail.

These and other objects and advantages of this invention will become more readily apparent when the following description is read in conjunction with the accompanying drawings.

DESCRIPTION OF THE PREFERRED EMBODIMENTS

Figure 1:
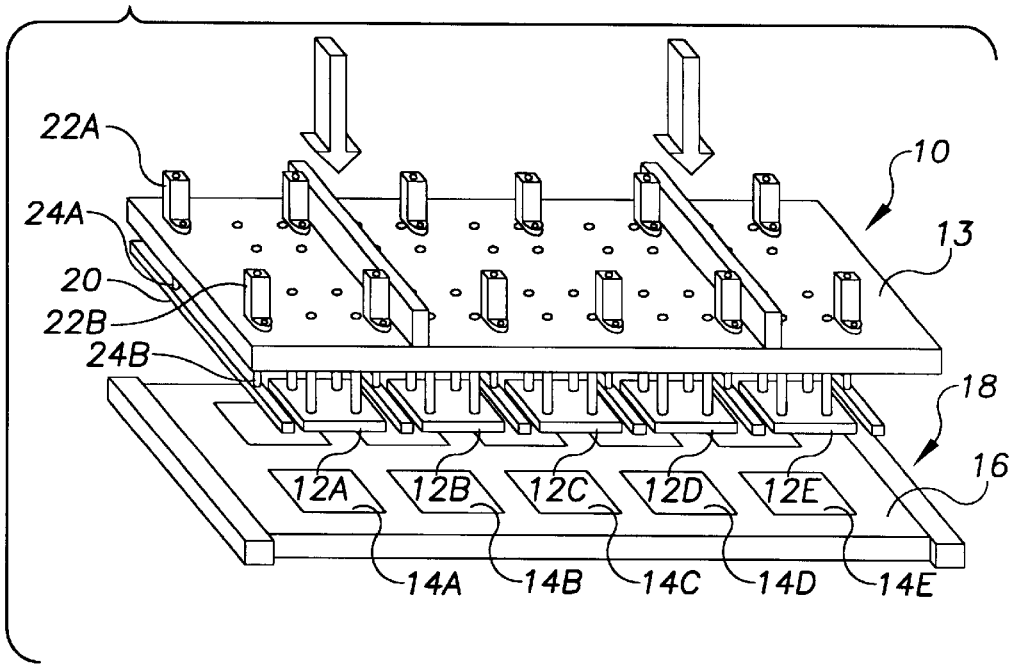
FIG. 1 PRIOR ART
FIG. 1 is a partial perspective view of a prior art male blanker and a female blanker cooperatively positioned to knock blanks out of a large sheet of packaging material.
Figure 2:
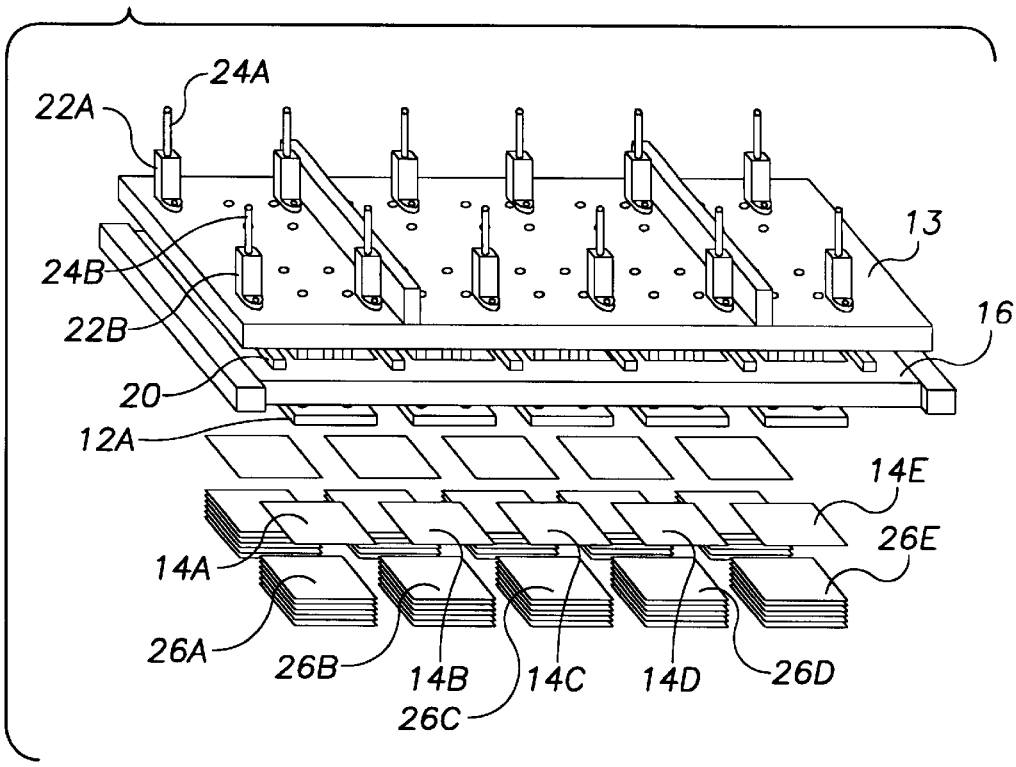
FIG. 2 PRIOR ART
FIG. 2 is a partial perspective view of the FIG. 1 prior art male and female blanker showing usage of a prior art presser rail in knocking out packaging blanks.
Figure 3:
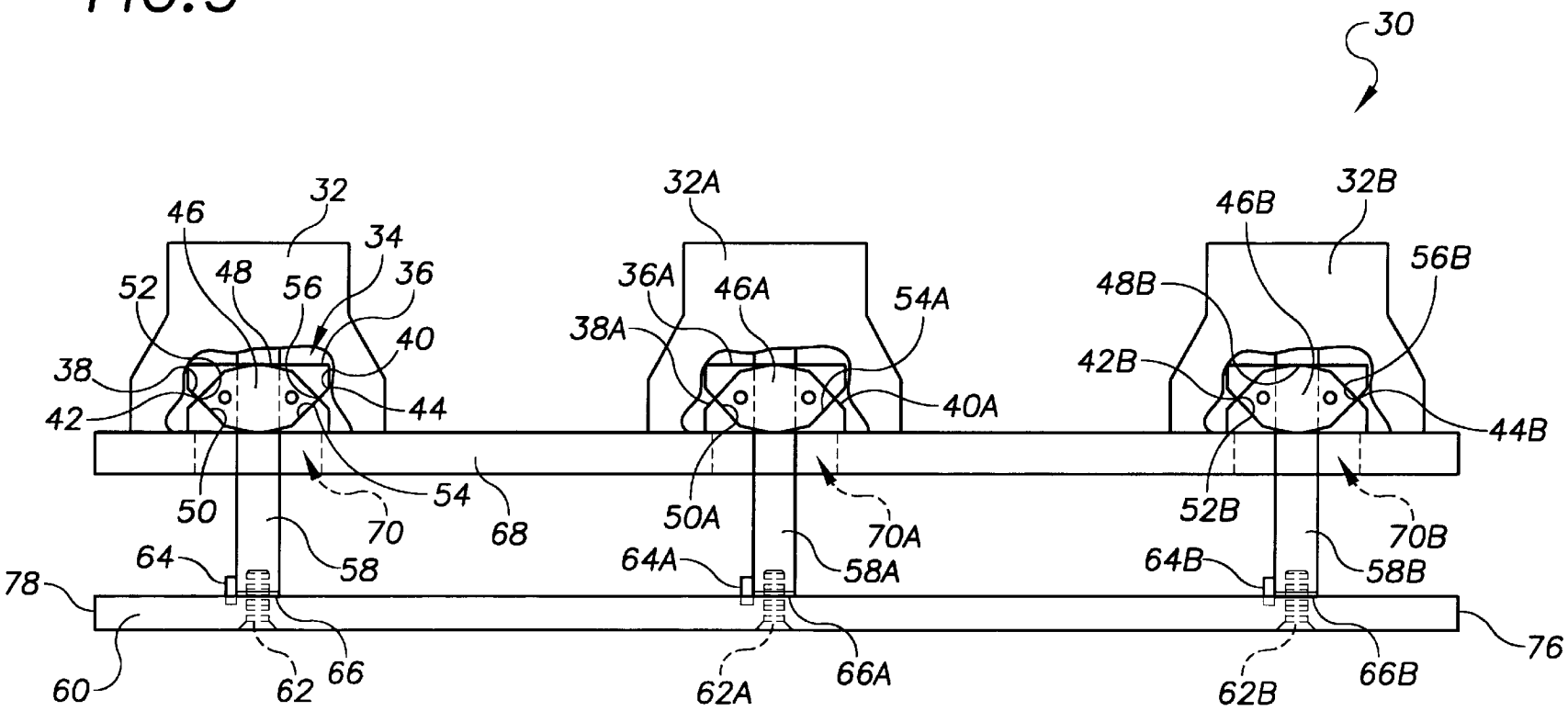
FIG. 3 is a front plan, fragmentary view of a moveable presser rail assembly constructed in accordance with the present invention showing a presser rail parallel to a support plate.
Figure 4:
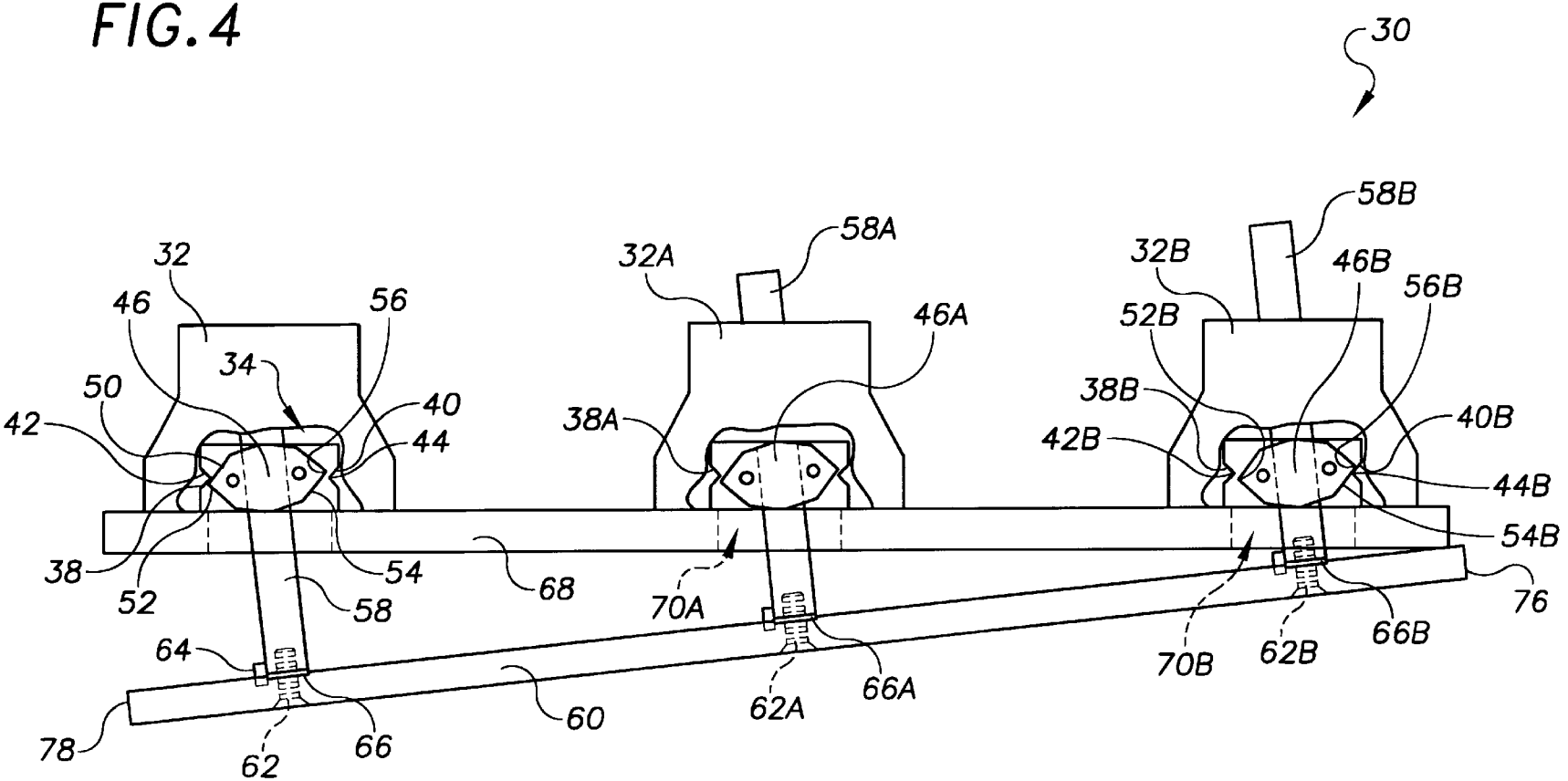
FIG. 4 is a front plan, fragmentary view of the FIG. 3 moveable presser rail assembly, showing the presser rail moved toward but not parallel to the support plate.

Referring to the drawings in detail, a moveable presser rail assembly constructed in accordance with the present invention is shown if FIGS. 3 and 4, and is generally designated by the reference numeral 30. As shown in FIG. 3, the moveable presser rail assembly includes at least one mount housing 32 having a cavity 34 that defines at least one stop shoulder 36, a first conical shoulder 38 and an opposed second conical shoulder 40. The first conical shoulder 38 includes a first tip 42 of the shoulder 38 and the second conical shoulder includes a second tip 44, and the first and second tips 42, 44 are at points of farthest protrusion of the first and second contact shoulders 38, 40 into the cavity 34. A pivot sleeve 46 is secured within the cavity 34, and includes an upper edge 48, a first convex edge 50 with a first contact corner 52, and a second convex edge 54 having a second contact corner 56. The first and second contact corners 52, 56 of the first and second convex edges are defined as being a farthest distance from each other on the pivot sleeve 46. As shown in FIG. 3, the pivot sleeve 46 and cavity 34 of the mount housing 32 are cooperatively dimensioned so that whenever the upper edge 48 of the pivot sleeve abuts or is adjacent to the stop shoulder 36, the first and second contact corners 52, 56 of the opposed first and second convex edges 50, 54 are positioned adjacent to the first and second tips 42, 44 of the opposed first and second conical shoulders 38, 40. A guide strut 58 is secured within the pivot sleeve 46 by a spring biasing means described below with respect to FIGS. 6 and 7, and a presser rail 60 is rigidly secured to the guide strut 58, such as by means of a standard machine screw 62 and alignment pin 64 between the presser rail 60 and a fastening end 66 of the guide strut 58.

In FIG. 3, a second mount housing 32A, second pivot sleeve 46A, and second guide strut 58A are shown secured to the same presser rail 60, as is a third mount housing 32B, third pivot sleeve 46B, and third guide strut 58B. To avoid confusion of an unnecessary multiplicity of reference numerals, all possible reference numerals associated with the first mount housing 32, pivot sleeve 46 and guide strut 58 are not added with the distinguishing letters "A" and "B" to identical components of the second and third mount housings 32A, 32B and second and third pivot sleeves 46A, 46B. Instead, the corresponding reference numerals that are associated with key components that are in close proximity to each other are shown respectively in the second and third mount housings 32A, 32B and second and third pivot sleeves 46A, 46B, for purposes of clarity.

The first, second and third mount housings 32, 32A, 32B are secured to a support plate 68 so that the first guide strut 58, passes through a first throughbore 70 of the support plate 68; the second guide strut 58A passes through a second throughbore 70A of the support plate 68; and, the third guide strut 58B passes through a third throughbore 70B of the support plate 68. The first, second and third throughbores 70, 70A, 70B are dimensioned as shown in FIGS. 3 and 4 so that they define a substantially greater width than a longest distance across a cross-section or a diameter of the guide struts 58, 58A, 58B passing through the throughbores 70, 70A, 70B. This restricts wearing contact between the support plate 68 and the guide struts 58, 58A, 58B as the presser rail 60 moves toward and away from the support plate 68. For purposes herein, the term "width" of the throughbores 70, 70A, 70B is defined to be in a direction perpendicular to a longitudinal axis of the presser rail 60, such as in a direction between the first guide strut 58 and the adjacent second guide strut 58A. Additionally, to permit a limited lateral movement of the guide struts 58, 58A, 58B, the throughbores 70, 70A, 70B have a length, the "length" being in a direction roughly parallel to the longitudinal axis of the presser rail 60, that is at least six per cent of the length of the presser rail 60 plus a longest distance across a cross-section of the guide strut 58 extending in a direction parallel to the longitudinal axis of the presser rail 60. Additionally, the first, second and third throughbores 70, 70B, 70C of the support plate 68 are dimensioned to have a smaller width (again, the "width" being a shortest distance across the throughbores perpendicular to the aforesaid length and parallel to a plane defined by the support plate 68) than a longest distance between a front contact edge 72 (shown in FIG. 6) and an opposed back contact edge 74 of the pivot sleeve 46. Therefore, whenever the mount housings 32, 32A, 32B are secured to the support plate 68, the pivot sleeves 46, 46A, 46B are secured within the cavity 34 of each mount housing 32, 32A, 32B and cannot be removed while the mount housings 32, 32A, 32B are secured over the throughbores 70, 70A, 70B of the support plate 68.

It is pointed out that, while three mount housings 32, 32A, 32B are shown in FIGS. 3 and 4 secured to one support plate 68 and one presser rail, the present moveable presser rail assembly 30 invention includes only at least one mount housing 32, one pivot sleeve 46 secured within the cavity 34 of the one mount housing 32, and one guide strut 58 secured within the pivot sleeve 46 and secured to one presser rail 60. It is within the scope of the present invention that the aforesaid one mount housing 32, pivot sleeve 46 and guide strut 58 secured to a presser rail 60 would replace one or more prior art presser rail assemblies secured to the same presser rail 60 in order to provide enhanced performance.

In FIG. 4, the presser rail 60 shown in FIG. 3 is shown having been moved in a direction that is both toward the support plate 68 and that is also lateral to the support plate, or that tends to move a first end 76 of the presser rail closer to the support plate 68 than an opposed second end 78 of the support plate 68. As a result of that movement, the first, second and third pivot sleeves 46, 46A, 46B pivots within the cavities 34 of their respective mount housing 32, as shown in FIG. 4. Whenever the pivot sleeve 46 pivots, the first and second contact corners 52, 56 of the first and second convex edges 50, 54 move out of contact with the first and second tips 42, 44 of the first and second conical corners 38, 40 of the cavity 34. Because of the cooperative relationship of the first conical corner 38 of the cavity 34 with the first convex edge 50 of the pivot sleeve 46 and the second conical corner 40 of the cavity 34 with the second convex edge 54, whenever the force that moved the presser rail 60 toward the support plate 68 in a non-parallel direction (such as shown in FIG. 4) is removed, the spring biasing means securing the guide strut 58 within the pivot sleeve 46 moves the first and second contact corners 52, 56 of the first and second convex edges 50, 54 back to being adjacent to the first and second tips 42, 44 of the first and second conical shoulders 38, 40 of the mount housing 32, so that the guide strut 58 is back to the being normal or perpendicular to the support plate 68 as shown in FIG. 3.

For example, as shown in FIG. 4, the third mount housing 32B adjacent to the first end 76 of the presser rail 60 has its spring biasing means compressed the most because the first end 76 of the presser rail 60 is moved closer to the support plate 68 than the second end 78 adjacent to the first mount housing 32. That non-parallel motion of the presser rail 60 toward the support plate 68 forces the second contact corner 56B of the second convex edge 54B of the third pivot sleeve 46B to slide up away from the support plate 68 out of contact with the second tip 44B of the second conical shoulder 40B and on to the second conical shoulder 40B. Because the second conical shoulder 40B is sloped toward the support plate 68, the spring biasing means that biases the fastening end 66B of the third guide strut 58B away from the support plate 68 thus forces the second convex edge 54B of the third pivot sleeve 46B to slide down that sloped second conical shoulder 40B until the second contact corner 56B of the third pivot sleeve 46A is again adjacent to the second tip 44B of the second conical shoulder 40B of the third mount housing 36B whenever the non-parallel force acting upon the presser rail 60 is removed.

It is pointed out that the descriptive phrase "conical shoulder" is meant to define any kinds of surfaces meeting in a tip, such as a conical shoulder that is conical in cross-section only, or that is conical through three dimensions, or that includes angular, curved or flat surfaces meeting at a tip wherein the angular, curved or flat surfaces are not symmetrical to each other, in other words, one of the surfaces leading to the tip may be curved, while the other is flat, etc. The same definition applies for purposes herein to the descriptive phrase "convex edge", wherein the phrase is meant to describe any kind of surfaces meeting in a tip or contact corner, such that the first and second contact corners 52, 56 of the first and second convex edges of the pivot sleeve 46 may cooperatively engage and interact as described above with the first and second tips 42, 44 of the first and second conical shoulders 38, 40 of the cavity 34 of the mount housing 32.

FIG. 4 clearly shows that whenever the presser rail 60 moves toward the support plate 68 in a non-parallel manner, such as when the first end 76 of the presser rail 60 is closer to the support plate 68 than the second end 78 of the presser rail 60, the pivot sleeve 46 rotates so that a gap opens between the second contact corner 56 of the pivot sleeve 46 and the second tip 44 of the second conical shoulder 40. Simultaneously, the first contact corner 52 of the first convex edge 50 moves out of contact with the first tip 42 of the first conical shoulder 38. That cooperative movement of the pivot sleeve 46 within the cavity 34 of the mount housing 32 permits the non-parallel movement of the rigidly secured presser rail 60 toward the support plate 68. The above described components of the moveable presser rail assembly 30 are the preferred embodiment.

However, it is pointed out that a non-parallel movement of the presser rail 60 could also be achieved in an alternative embodiment (not shown) if the cavity 34 of the mount housing 32 defined only one conical shoulder, and the pivot sleeve 46 defined only one convex edge, and such a pivot sleeve was secured so that a contact corner of the only one convex edge was secured adjacent a tip of the only one conical shoulder defined within the cavity of the mount housing. Such an alternative embodiment is defined to be included hereinafter within an embodiment of the moveable presser rail assembly having a mount housing having a cavity that defines at least one conical shoulder that protrudes into the cavity, and having a pivot sleeve secured within the cavity, the pivot sleeve having at least one convex edge, wherein the pivot sleeve is secured within the cavity so that whenever a stop shoulder of the mount housing contacts an upper edge of the pivot sleeve a contact corner of the at least one convex edge of the pivot sleeve is positioned adjacent a tip of the at least one conical shoulder of the cavity, along with other components of the moveable presser rail assembly 30 described herein.

Figure 5:
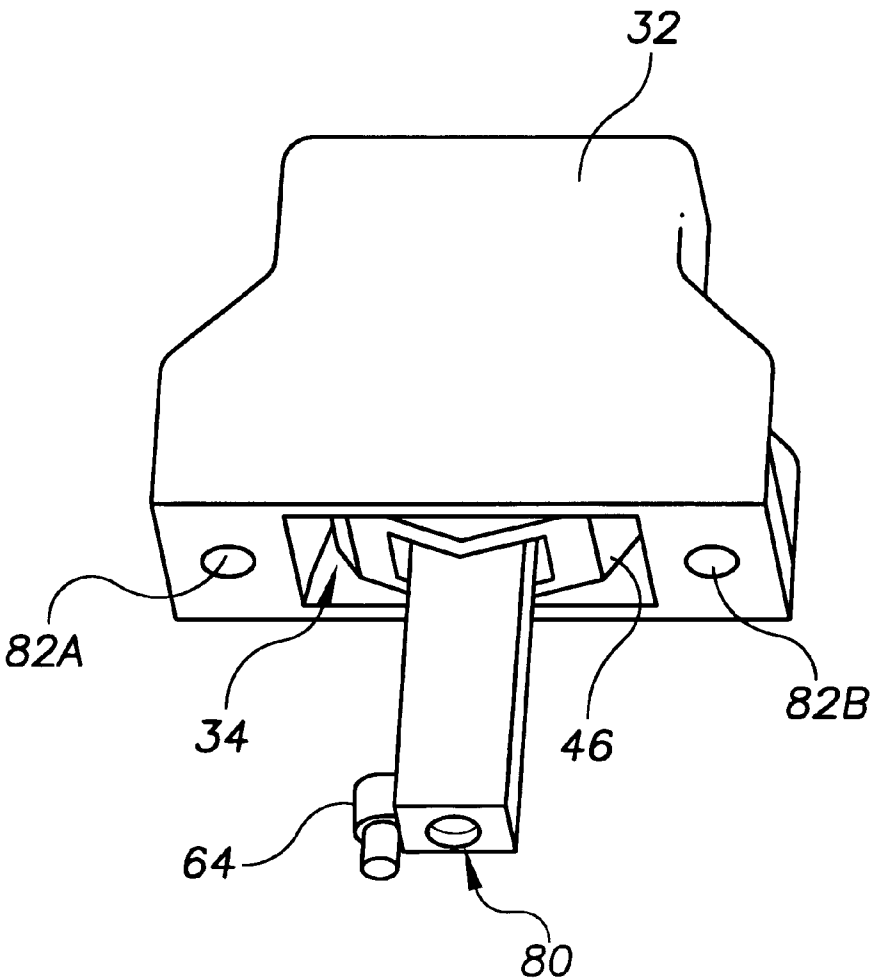
FIG. 5 is a bottom perspective view of a mount housing, pivot sleeve and guide strut of a moveable presser rail assembly constructed in accordance with the present invention.

FIG. 5 shows a perspective view of the mount housing 32 removed from the support plate 68 showing the pivot sleeve 46 secured within the cavity 34 of the housing 32. Also shown is the guide strut 58 projecting out of the cavity 34, with its alignment pin 64 adjacent the fastening end 66 of the guide strut 58 having a fastening bore 80 for receiving the screw 62 that rigidly secures the presser rail 60 to the guide strut 58. Also shown in FIG. 5 are two securing holes 82A, 82B that assist in securing the mount housing 32 to the support plate 68.

Figure 6:
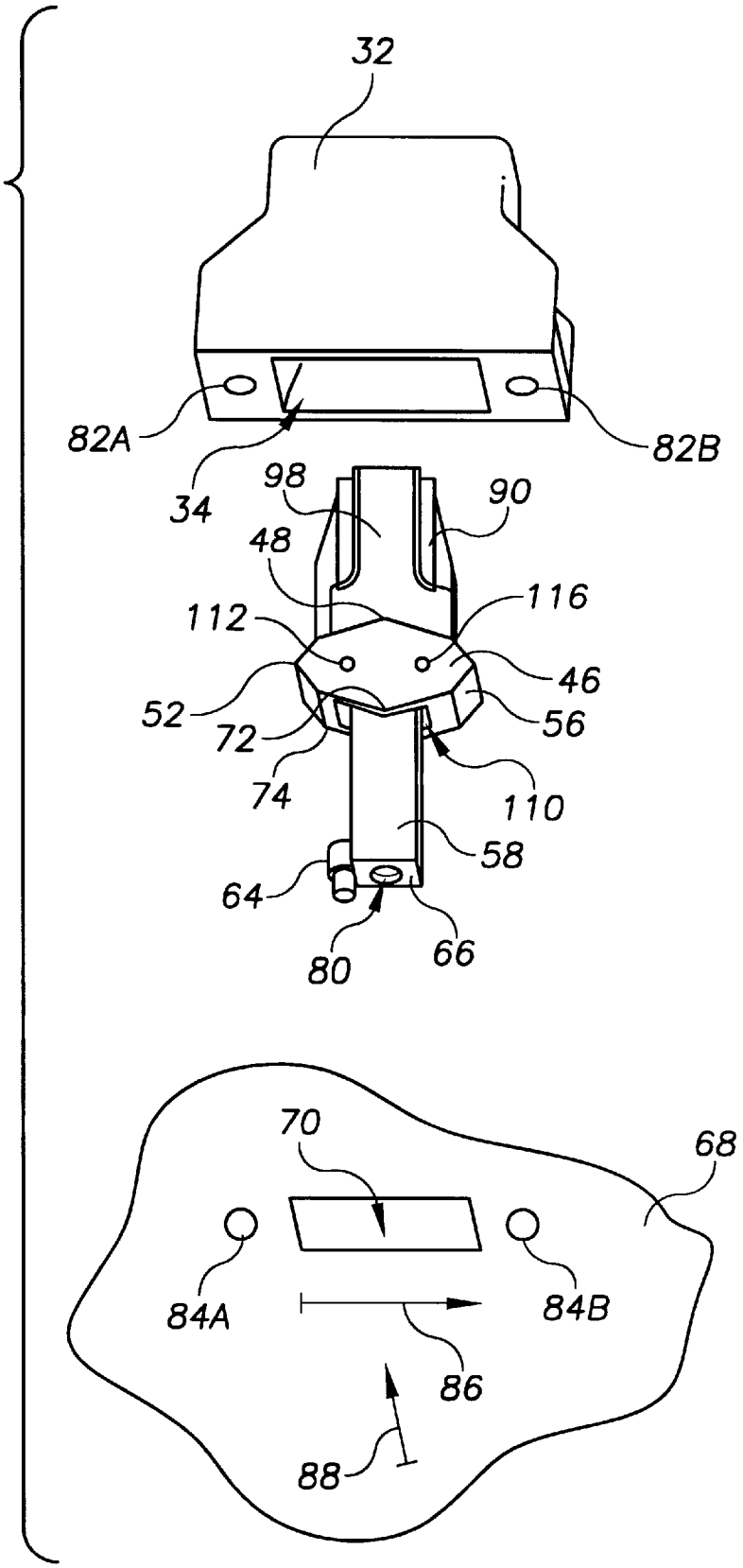
FIG. 6 is a perspective view of a pivot sleeve and guide strut removed from a mount housing of a moveable presser rail assembly constructed in accordance with the present invention.

FIG. 6 shows the pivot sleeve 46 and guide strut 58 secured therein removed from the mount housing 32 and supported over a section of the support plate 68. The support plate 68 includes the throughbore 70 and a first receiving hole 84A and a second receiving hole 84B that are positioned to cooperate with the first securing hole 82A and second securing hole 82B of the mount housing 32 for securing the housing 32 to the support plate 68. Also shown in FIG. 6 is a length directional arrow 86 and a width directional arrow 88 that further serve to define the "length" and "width" of the throughbore 70 of the support plate. As described above, the length of the throughbore 70 is dimensioned relative to a longest distance across a cross-section of the guide strut 58 that is at least six per cent of the length of the presser rail 60 plus the aforesaid length of the cross-section of the guide strut 58. The "length" of the throughbore 70 therefore is in a direction parallel to the length directional arrow 86. The "width" of the throughbore 70 therefore is in a direction parallel to the width directional arrow 88.

In FIG. 6, the front contact edge 72 and opposed back contact edge 74 of the pivot sleeve 46 are shown, and as described above are defined to have a longest distance between opposed portions of the front and back contact edges 72, 74 that is longer than the width of the throughbore 70 so that whenever the mount housing 32 is secured to the support plate 68, the pivot sleeve 46 cannot pass out of the cavity 34 of the mount housing 32. The pivot sleeve 46 is also defined so that whenever the front contact edge 72 or back contact edge 74 contact the support plate 68, the upper edge 48 of the pivot sleeve 46 contacts the stop shoulder 36 (shown best in FIGS. 3, 4 and 8) of the mount housing 32.

Figure 7:
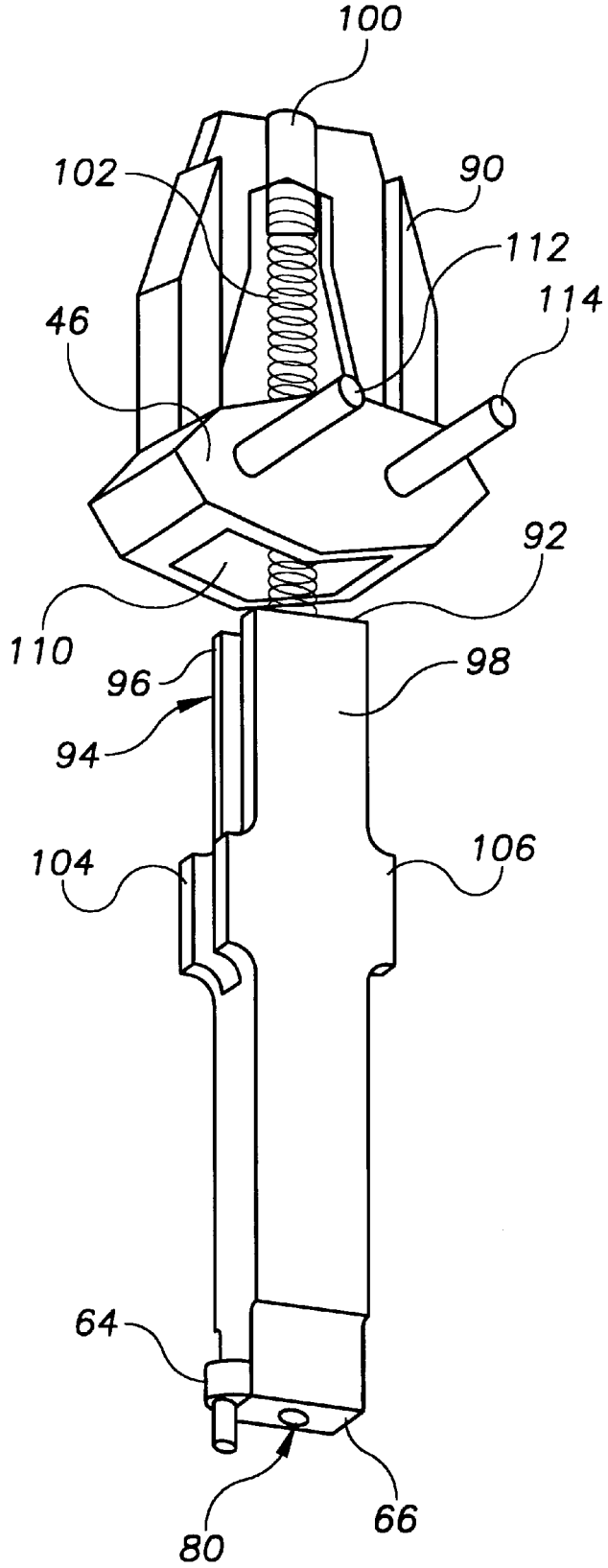
FIG. 7 is a perspective view of a guide strut removed from a pivot sleeve of a moveable presser rail assembly constructed in accordance with the present invention.

FIGS. 6 and 7 also show a preferred spring biasing means for biasing the fastening end 66 of the guide strut 58 away from the mount housing 32 and support plate 68. A forked spring receiver 90 is secured to the pivot sleeve 46 and extends above the pivot sleeve in a direction opposed to the fastening end 66 of the guide strut 58. A spring end 92 of the guide strut is opposed to the fastening end and defines a spring bore 94 (shown also in FIG. 9) between a first finger 96 and second finger 98 of the spring end 92 of the guide strut 58. The forked spring receiver 90 includes a spring lug 100 that receives and secures a coil spring 102 and the coil spring is also received and secured within the spring bore 94 of the spring end 92 of the guide strut 58. The first and second fingers 96, 98 of the spring end 92 of the guide strut 58 are positioned and dimensioned so that they slide over the forked spring receiver 90 of the pivot sleeve 46 as the coil spring 102 is compressed. The guide strut also includes a first mount shoulder 104 and a second mount shoulder 106 (shown best in FIG. 7) dimensioned to pass through a guide slot 110 defined within the pivot sleeve 46 so that a first lock rod 112 and a second lock rod 114 pass through the pivot sleeve 46 whenever the mount shoulders 104, 106 are forced through the guide slot 110 to be between the pivot sleeve 46 and spring lug 100. The first and second mount shoulders 104, 106 are dimensioned cooperatively with the first and second lock rods 112, 114 so that when the first and second lock rods 112, 114 are secured within the pivot sleeve 46 and guide slot 110, the mount shoulders 104, 106 and may slide against the spring biasing of the coil spring 102 toward the spring lug 100, but are blocked by the first and second lock rods 112, 114 from movement toward the support plate 68.

Figure 9:
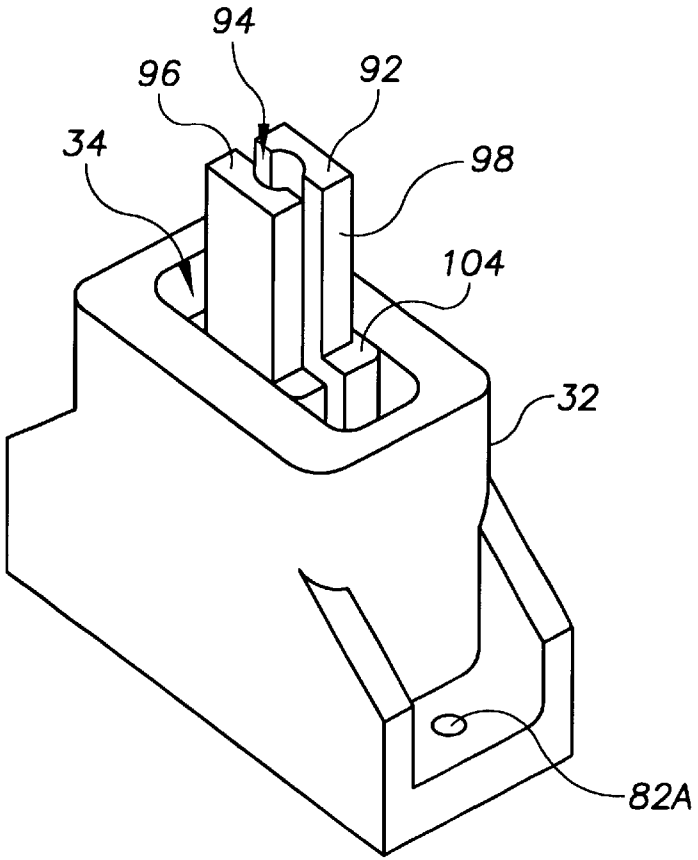
FIG. 9 is a top perspective view of a mount housing showing fingers of a guide strut extending from the mount housing of a moveable presser rail assembly constructed in accordance with the present invention.

As is apparent from FIGS. 6 and 7, to secure the spring biased guide strut 58 within the pivot sleeve 46, a user (not shown) simply slides the spring bore 94 of the guide strut 58 to receive the coil spring 102 and pass through the guide slot 110 so that the first and second mount shoulders 104, 106 are positioned between the pivot sleeve and the spring lug 100, and then the user secures the first and second lock rods 112, 114 to pass through the guide slot 110 below the mount shoulders 104, 106, and the guide strut 58 is thereby secured and spring biased within the pivot sleeve 46 so that the fastening end 66 of the pivot rod is biased away from the pivot sleeve 46 and support plate 68. The first and second fingers 96, 98 of the guide strut 58, the forked spring receiver 90 and the mount housing 32 may be cooperatively dimensioned so that whenever the coil spring 102 secures the mount shoulders 104, 106 against the lock rods 112, 114, the first and second fingers 96, 98, are completely within the cavity 34 of the mount housing 32, and the first and second fingers only extend out of cavity 32 of the mount housing 34 when the fastening end 66 of the guide strut 58 is compressed toward the pivot sleeve 46, as shown in FIG. 9. The cooperative relationship of the first and second fingers 96, 98 of the guide strut 58 sliding over the forked spring receiver 90 also adds stability and strength to the spring biasing means and moveable presser rail assembly 30 as the fastening end of the guide strut 58 is repeatedly reciprocating toward and away from the pivot sleeve 46.

Figure 8:
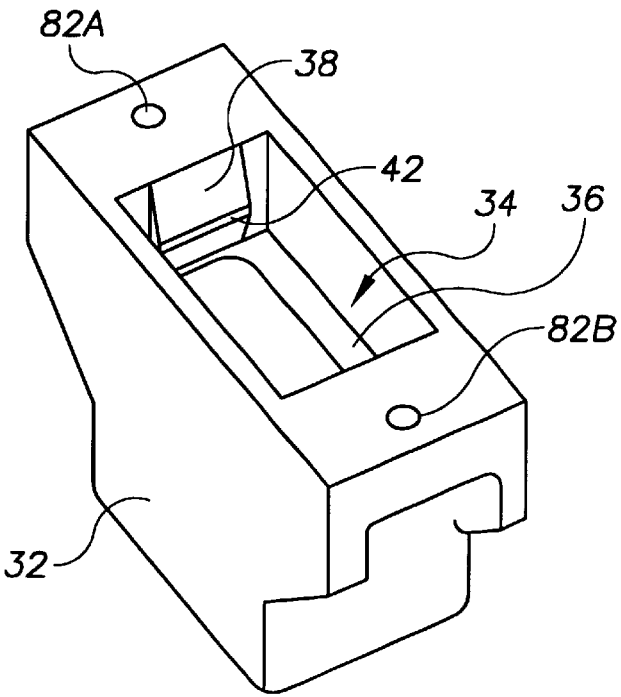
FIG. 8 is a top perspective view of a mount housing showing a stop shoulder and a conical shoulder of a moveable presser rail assembly constructed in accordance with the present invention.

FIG. 8 is a view of the cavity 34 of the mount housing 32 for purposes of showing a preferred form of the first tip 42 of the first conical shoulder 38 relative to the stop shoulder 36. As can be seen, in such a preferred construction, the mount housing may be readily manufactured by known plastic manufacturing techniques to produce a rugged, durable, and inexpensive component that is easy to assemble and use.

Figure 10:
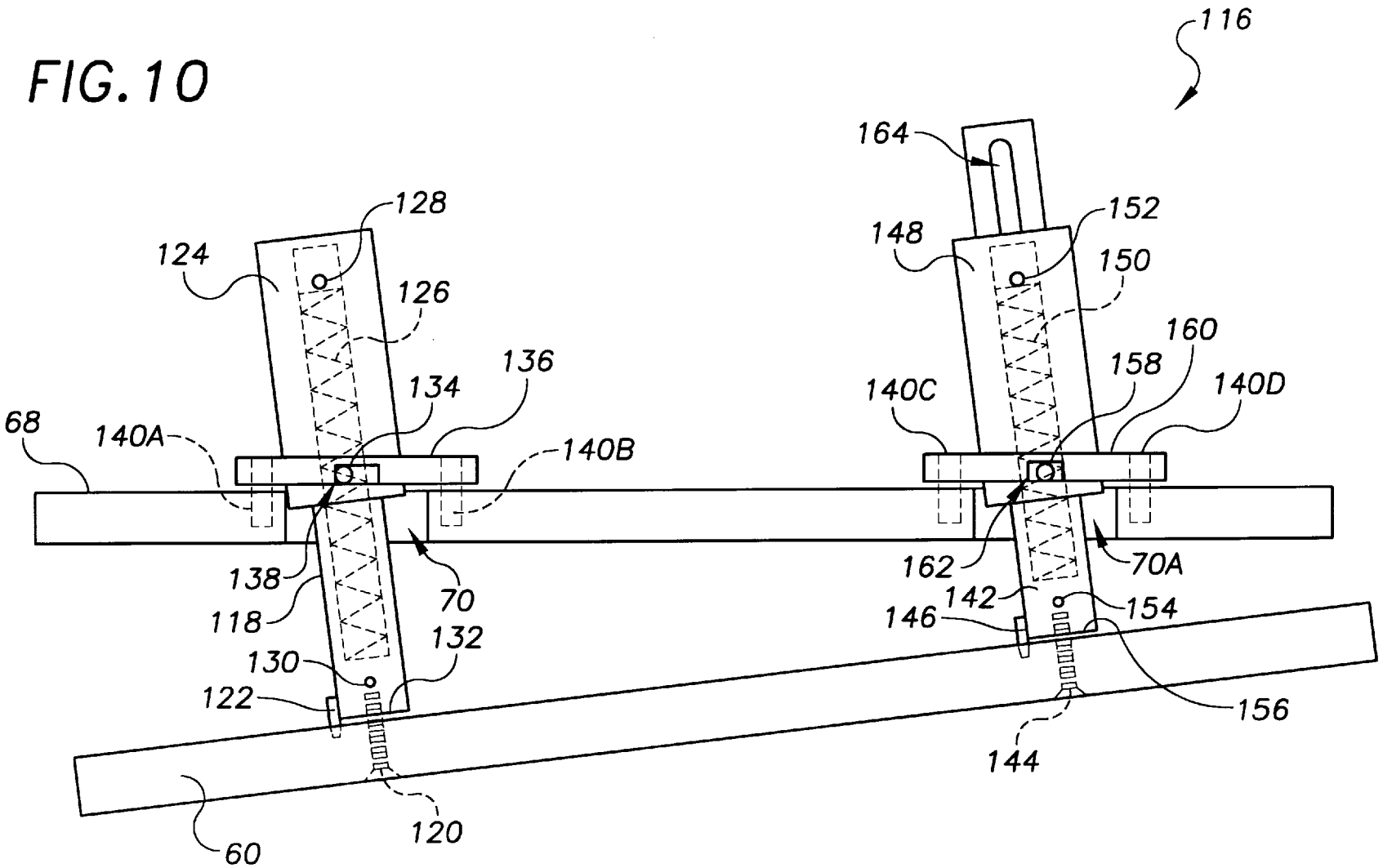
FIG. 10 is a fragmentary side plan view of an alternative moveable presser rail assembly constructed in accordance with the present invention.

FIG. 10 shows an alternative or pivot slot embodiment of a moveable presser rail assembly 116. The pivot slot moveable presser rail assembly 116 includes a first guide strut 118 rigidly secured to the presser rail 60 by a first fastener 120 and first alignment pin 122, wherein the first guide strut 118 is secured within a first spring cylinder 124 by spring biasing means, such as a first coil spring 126 secured between a first spring top stop 128 in the spring cylinder 124 and a first spring bottom stop 130 in the first guide strut 118 for biasing the guide strut 118 so that a fastening end 132 of the guide strut 118 is biased away from the support plate 68; the first spring cylinder 124 includes a first pivot axle 134; and a first mount housing 136 defines an expanded pivot slot 138 that captures and secures the first pivot axle 134 between the first mount housing 136 and the support plate 68, wherein the expanded pivot slot 138 has a length parallel to a longitudinal axis of the presser rail 60 that is at least two per cent of the longitudinal axis or length of the presser rail 60 plus a longest distance across, or a diameter of the first pivot axle 134 in order to permit limited lateral movement of the first pivot axle 134 within the first pivot slot 138. A pivot slot having such a length will hereinafter be referred to for convenience as an "expanded pivot slot" 138. The first mount housing may be secured to the support plate 68 by a first housing fastener 140A and a second housing fastener 140B. The first mount housing 136 secures the first guide strut 118 to pass through the throughbore 70 of the presser rail which throughbore 70 has the same length relative to the first guide strut 118 as described above to permit lateral movement of the first guide strut 118.

The pivot slot moveable presser rail assembly 116 also includes a second guide strut 142 rigidly secured to the presser rail 60 by a second fastener 144 and second alignment pin 146, wherein the second guide strut 142 is secured within a second spring cylinder 148 by spring biasing means, such as a second coil spring 150 secured between a second spring top stop 152 in the second spring cylinder 148 and a second spring bottom stop 154 in the second guide strut 142, for biasing the second guide strut 142 so that a fastening end 156 of the second guide strut 142 is biased away from the support plate; the second spring cylinder 148 having a second pivot axle 158; and a second mount housing 160 defines an axle pivot slot 162 that captures and secures the second pivot axle 158 between the second mount housing 160 and the support plate 68, wherein the axle pivot slot 162 has a length parallel to the longitudinal axis of the presser rail 60 that is slightly greater than a diameter of the second pivot axle 158 in order to limit lateral movement of the second pivot axle 158 within the axle pivot slot 162. For purposes herein, a pivot slot having a length slightly greater than a diameter of a pivot axle within the pivot slot will be referred to for convenience as an "axle pivot slot" 162. As shown in FIG. 10, as the fastening end 156 of the second guide strut 142 is compressed toward the support plate, a guide slit 164 of the second guide strut 142 moves out of the second spring cylinder 148. The second mount housing 160 may be secured to the support plate 68 by a third housing fastener 140C and a fourth housing fastener 140D.

Because the expanded pivot slot 138 of the first mount housing 136 permits limited lateral movement of the first pivot axle 134 of the first spring cylinder 124 as the presser rail 60 moves laterally and toward the support plate 68, the pivot slot embodiment 116 of the moveable presser rail assembly also permits movement of the presser rail 60 toward the support plate 68 that is not parallel to the support plate 68 (as shown in FIG. 10) with the first and second guide struts 118, 142 rigidly secured to the presser rail 60 for ease of manufacture and assembly of the guide struts 118, 142 and presser rail 60. The embodiments of the moveable presser rail 30 assembly described above in association with FIGS. 1–9, and the pivot slot embodiment 116 all achieve a rigid mounting of the guide struts 58, 118, 142 to the presser rail 60 which facilitates manufacture, installation and replacement of the moveable presser rail assemblies 30, 116 in male blankers 10 in packaging material blanking operations. In particular, the presser rail 60 may simply be fabricated of standard rectangular aluminum bar stock that is well known to be available as "off the shelf" product, thereby greatly simplifying manufacture, assembly and maintenance of the moveable presser rail assembly 30.

While the present invention has been described and illustrated with respect to particular constructions and illustrations of preferred embodiments of moveable presser rail assemblies 30, 116, it should be understood that the invention is not limited to the described and illustrated examples. For example, while the "spring biasing means" described in securing the guide strut 58 within the pivot sleeve 46 and in biasing the fastening end 66 of that guide strut 58 away from the pivot support plate 68 is characterized as a coil spring 102 secured within spring bore 94 of the guide strut 58 defined between first and second fingers 96, 98 of the guide strut 58 that cooperate to slide over the forked spring receiver 90 secured to the pivot sleeve 46, any known mechanism that can bias a guide strut structure as described while fulfilling the function of the described spring biasing means is within the scope of the present invention. Additionally, while the pivot sleeve 46 is described as being secured within the cavity 34 of the mount housing 32 by the limited width of the throughbore of the support plate 68, any known structural mechanism that can secure such a pivot sleeve 46 within a cavity 32, such as compressible ridges, mechanical latches, hooks, etc., is within the scope of the invention. Further, an embodiment of the moveable presser rail assembly wherein the mount housing cavity defines only one conical shoulder and the pivot sleeve defines only one convex edge secured adjacent to the conical shoulder is also within the scope of the invention. Accordingly, reference should be made primarily to the attached claims rather than to foregoing description to determine the scope of the invention.

What is claimed is:

1. A moveable presser rail assembly for supporting blanking material during operation of a blanking tool for making packaging blanks, the moveable presser rail assembly comprising:

a. a mount housing having a cavity that defines at least one stop shoulder, and at least one conical shoulder protruding into the cavity and having a tip of the conical shoulder at a point of farthest protrusion of the at least one conical shoulder into the cavity;

b. a pivot sleeve secured within the cavity of the mount housing, the pivot sleeve having an upper edge, at least one convex edge, and the pivot sleeve being dimensioned to be secured within the cavity of the mount housing so that when the upper edge of the pivot sleeve contacts the stop shoulder, a contact corner of the at least one convex edge of the pivot sleeve is positioned adjacent to the tip of the at least one conical shoulder of the mount housing;

c. a guide strut secured within the pivot sleeve by a spring biasing means for biasing a fastening end of the guide strut to move away from the mount housing; and, d. a presser rail rigidly secured to the fastening end of the guide strut.

2. The moveable presser rail assembly of claim 1, wherein the mount housing is secured to a support plate that defines a throughbore so that the guide strut passes through the throughbore and the throughbore has a length parallel to a longitudinal axis of the presser rail that is at least six per cent of the length of the presser rail plus a longest distance across a cross-section of the guide strut extending in a direction parallel to the longitudinal axis of the presser rail to permit limited lateral movement of the guide strut.

3. The moveable presser rail assembly of claim 2, wherein the throughbore has a width perpendicular to the longitudinal axis of the presser rail that is less than a longest distance between opposed contact edges of the pivot sleeve.

4. The moveable presser rail assembly of claim 2, wherein the pivot sleeve is dimensioned so that when a contact edge of the pivot sleeve contacts the support plate the upper edge of the pivot sleeve contacts the stop shoulder of the mount housing.

5. The moveable presser rail assembly of claim 1, further comprising:

a. the cavity defining a first conical shoulder and an opposed second conical shoulder, wherein the first and second conical shoulders both protrude into the cavity and first and second tips of the first and second conical shoulders are at points of farthest protrusion of the first and second conical shoulders into the cavity; and, b. the pivot sleeve includes a first convex edge and an opposed second convex edge, and the pivot sleeve being dimensioned to be secured within the cavity of the mount housing so that when the upper edge of the pivot sleeve contacts the stop shoulder, a first contact corner of the first convex edge of the pivot sleeve is positioned adjacent to the first tip of the first conical shoulder of the mount housing and a second contact corner of the second convex edge of the pivot sleeve is positioned adjacent to the second tip of the second conical shoulder of the mount housing, wherein the contact corners of the first and second convex edges are defined as being a farthest distance from each other on the pivot sleeve.

6. The moveable presser rail assembly of claim 1, wherein the spring biasing means comprises a forked spring receiver secured to the pivot sleeve and extending away from the pivot sleeve in a direction opposed to the fastening end of the guide strut, the forked spring receiver including a spring lug that secures a coil spring that extends into a spring bore defined between a first finger and a second finger of the guide strut at a spring end of the guide strut opposed to the fastening end, wherein the first and second fingers of the guide strut are dimensioned to slide over the forked spring receiver whenever the coil spring is compressed.

7. The moveable presser rail assembly of claim 6, wherein the guide strut includes at least one mount shoulder dimensioned to slide through a guide slot defined within the pivot sleeve, and the pivot sleeve includes at least one lock rod that passes through the guide slot perpendicular to the guide strut and positioned so that the lock rod secures the shoulder mount between the pivot sleeve and the spring lug.

8. A moveable presser rail assembly for supporting blanking material during operation of a blanking tool for making packaging blanks, the moveable presser rail assembly comprising:

a. a mount housing having a cavity that defines means for pivotally securing a pivot sleeve within the cavity;

b. a guide strut secured within the pivot sleeve by a spring biasing means for biasing a fastening end of the guide strut to move away from the mount housing;

c. a presser rail rigidly secured to the fastening end of the guide strut; and, d. wherein the mount housing is secured to a support plate that defines a throughbore so that the guide strut passes through the throughbore and the throughbore has a length parallel to a longitudinal axis of the presser rail that is at least six per cent of the length of the presser rail plus a longest distance across a cross-section of the guide strut extending in a direction parallel to the longitudinal axis of the presser rail to permit limited lateral movement of the guide strut.

9. The moveable presser rail assembly of claim 8, wherein the spring biasing means comprises a forked spring receiver secured to the pivot sleeve and extending away from the pivot sleeve in a direction opposed to the fastening end of the guide strut, the forked spring receiver including a spring lug that secures a coil spring that extends into a spring bore defined between a first finger and a second finger of the guide strut at a spring end of the guide strut opposed to the fastening end, wherein the first and second fingers of the guide strut are dimensioned to slide over the forked spring receiver whenever the coil spring is compressed.

* * * * *